US008303041B2

(12) United States Patent
Gasser

(10) Patent No.: US 8,303,041 B2
(45) Date of Patent: Nov. 6, 2012

(54) FURNITURE BASE WITH CENTRAL COLLECTOR

(75) Inventor: Louis Francis Gasser, Girard, OH (US)

(73) Assignee: Gasser Chair Company, Inc., Youngstown, OH (US)

( * ) Notice: Subject to any disclaimer, the term of this patent is extended or adjusted under 35 U.S.C. 154(b) by 235 days.

(21) Appl. No.: 12/823,549

(22) Filed: Jun. 25, 2010

(65) Prior Publication Data

US 2011/0316313 A1 Dec. 29, 2011

(51) Int. Cl.
*A47C 7/00* (2006.01)
*A47C 9/00* (2006.01)
*F16M 11/00* (2006.01)

(52) U.S. Cl. ..... 297/440.22; 297/445.1; 297/461; 248/163.1; 248/164

(58) Field of Classification Search ..... 297/45, 297/440.22, 461, 445.1; 248/163.1, 164; D6/499
See application file for complete search history.

(56) References Cited

U.S. PATENT DOCUMENTS

| | | | | | |
|---|---|---|---|---|---|
| 72,635 | A | | 12/1867 | Heywood | |
| 163,623 | A | * | 5/1875 | Allen | 297/461 |
| 647,171 | A | * | 4/1900 | Wiles | 248/164 X |
| 1,355,944 | A | * | 10/1920 | Dale | 248/164 X |
| D76,863 | S | | 11/1928 | Ferris | |
| D83,179 | S | * | 1/1931 | Scott et al. | 248/163.1 X |
| 1,997,660 | A | * | 4/1935 | Smith | 108/157.15 |
| D104,154 | S | | 4/1937 | Andersen | |
| 2,368,740 | A | * | 2/1945 | Blomgren | 248/164 X |
| D156,463 | S | | 12/1949 | Rita | |
| 2,498,837 | A | * | 2/1950 | Gelman | 297/461 X |
| 2,562,022 | A | * | 7/1951 | Duer | 248/163.1 X |
| D182,024 | S | * | 2/1958 | Greenberg | 297/461 X |
| D192,323 | S | | 3/1962 | Shaw | |
| 3,032,307 | A | | 5/1962 | Nelson et al. | |
| 3,032,380 | A | * | 5/1962 | Danciart et al. | 108/154 |
| D195,946 | S | | 8/1963 | Kronhaus | |
| D197,712 | S | | 3/1964 | Fisher, Jr. | |
| 3,164,347 | A | * | 1/1965 | McMasters | 297/440.22 X |
| 3,366,079 | A | * | 1/1968 | Koransky et al. | 108/157.15 |
| 3,591,113 | A | * | 7/1971 | Foster, Jr. | 248/163.1 X |
| D232,880 | S | | 9/1974 | Samhammer | |
| 4,169,625 | A | * | 10/1979 | Petersen | 297/440.22 X |
| D279,634 | S | | 7/1985 | Platner | |
| D280,275 | S | * | 8/1985 | Criqui et al. | D6/487 |
| 4,547,015 | A | * | 10/1985 | Wakimoto | 297/45 X |
| D299,986 | S | | 2/1989 | Doughty | |
| 4,941,413 | A | * | 7/1990 | Vanderminden | 108/157.15 |
| 5,131,718 | A | * | 7/1992 | Cooper | 297/452.1 |
| D353,912 | S | * | 12/1994 | Shiao | D6/499 X |
| D359,639 | S | * | 6/1995 | Noll | D6/487 |
| 5,439,269 | A | * | 8/1995 | Cheng | 297/440.22 X |

(Continued)

*Primary Examiner* — Rodney B White
(74) *Attorney, Agent, or Firm* — Lerner, David, Littenberg, Krumholz & Mentlik, LLP

(57) ABSTRACT

A furniture base including a plurality of legs, each leg may include a top portion, a bottom portion, and at least one curve along at least a portion of its length; a central collector which may include a plurality of compartments; and the plurality of compartments and the plurality of legs may be arranged relative to one another such that one of the top or bottom portions of each leg may be positioned within each compartment, and the other of the top or bottom portions of each leg may be positioned away from the central collector; wherein, for each leg, the portion of the leg positioned within the compartment may be positioned in one of the compartments other than the compartment arranged closest to the other portion of the leg.

18 Claims, 8 Drawing Sheets

U.S. PATENT DOCUMENTS 5,851,052 A * 12/1998 Gustafsson ..... 248/164 X
D414,947 S 10/1999 Liu
6,270,156 B1 * 8/2001 Metzger et al. ..... 297/45 X
D449,490 S * 10/2001 Frederick ..... D7/332
6,398,040 B1 * 6/2002 Gregory ..... 211/14
D487,986 S 4/2004 Muller
6,749,265 B1 * 6/2004 Wang ..... 297/440.22 X
6,799,797 B2 * 10/2004 Cochran et al. ..... 248/164 X
6,863,250 B2 * 3/2005 Nauseda et al. ..... 248/150
7,384,097 B2 * 6/2008 Park et al. ..... 297/45
D579,677 S 11/2008 Zhou et al.
D599,142 S * 9/2009 Lovegrove ..... D6/499 X
7,722,123 B2 * 5/2010 Holland ..... 297/461 X
7,748,777 B2 * 7/2010 Park et al. ..... 297/45
8,141,944 B2 * 3/2012 Reeb et al. ..... 297/45
2004/0041064 A1 3/2004 Cheng

* cited by examiner

FURNITURE BASE WITH CENTRAL COLLECTOR

BACKGROUND OF TEE INVENTION

Furniture, and particularly furniture for use in public social settings, such as casinos, restaurants, convention halls, and the like, must be functional, sturdy and appealing to the eye. One important aspect of a piece of furniture is the support base, which should adequately support the piece of furniture. The base, particularly for elevated pieces of furniture such as barstools and tables, should be very stable and sturdy and should also be appealing to the eye as the base is typically seen by a viewer.

Such bases for elevated furniture undergo additional stresses than other types of furniture, such as lower chairs. This is particularly true when the base, nearest the piece of furniture, is narrower than the piece of furniture itself. The base undergoes various stresses including torsional stresses (rotation of furniture relative to the base), bending stresses (downward or upward forces applied to an edge of the piece of furniture), and shearing stresses (sliding of base along the floor). Each of these stresses are exaggerated in elevated furniture due to the leverage of the piece of furniture because of the taller base.

BRIEF SUMMARY OF TEE INVENTION

In a first embodiment, the invention may include a furniture base including a plurality of legs, each leg including a top portion, a bottom portion, and at least one curve along at least a portion of its length; a central collector which may include a plurality of compartments; and the plurality of compartments and the plurality of legs may be arranged relative to one another such that one of the top or bottom portions of each leg may be positioned within each compartment, and the other of the top or bottom portions of each leg may be positioned away from the central collector; wherein, for each leg, the portion of the leg positioned within the compartment may be positioned in one of the compartments other than the compartment arranged closest to the other portion of the leg.

The furniture base may further include each leg having two or more curves along two or more portions of its length. Each leg may also lie along a single plane along substantially its entire length.

The furniture base is intended to support a piece of furniture, wherein the piece of furniture may be selected from a chair, a table, or a bar stool.

Further, the opposite end of each leg may include a flange plate, which may further include a glide. The glide may be made from a polymer or like material.

Moreover, each leg may be constructed from a hollow cylindrical tube, which may be made of steel, stainless steel, aluminum, polymer or the like.

The collector may house one of the top or bottom portions of each of the legs. One embodiment of the central collector may include a unitary, generally cylindrical structure, wherein the individual compartments may be separated from one another by a deformation of the generally cylindrical structure. Further, the deformation may be depressed dimples between two individual compartments.

In another embodiment, the present invention may include a furniture base having a first leg, a second leg, a third leg and a fourth leg, each leg having a top portion, a bottom portion, and at least one curve along at least a portion of its length; a central collector having four compartments, each compartment positioned off-center relative the central collector; the first leg may be positioned parallel to the third leg; the second leg may be positioned parallel to the fourth leg; one of the top or bottom portions of each leg may be positioned in one of the four compartments; the first and third legs may be positioned at an angle transverse to the second and fourth legs. Further, the first and third legs may be positioned at an angle perpendicular to the second and fourth legs.

In yet a further embodiment, the present invention may include a furniture base having four legs, each leg including a top portion, a bottom portion, a first curve and a second curve along at least a portion of its length, the leg lying along a single plane along substantially its entire length; a central collector may include a unitary structure and four compartments, the compartments may be separated from one another by a deformation of the unitary structure; the top portion of each leg positioned in each compartment and the bottom portion of each leg positioned away from the central collector; and for each leg, the top portion may be positioned in one of the compartments other than the compartment arranged closest to the bottom portion.

BRIEF DESCRIPTION OF TEE DRAWINGS

DETAILED DESCRIPTION

Figure 1:
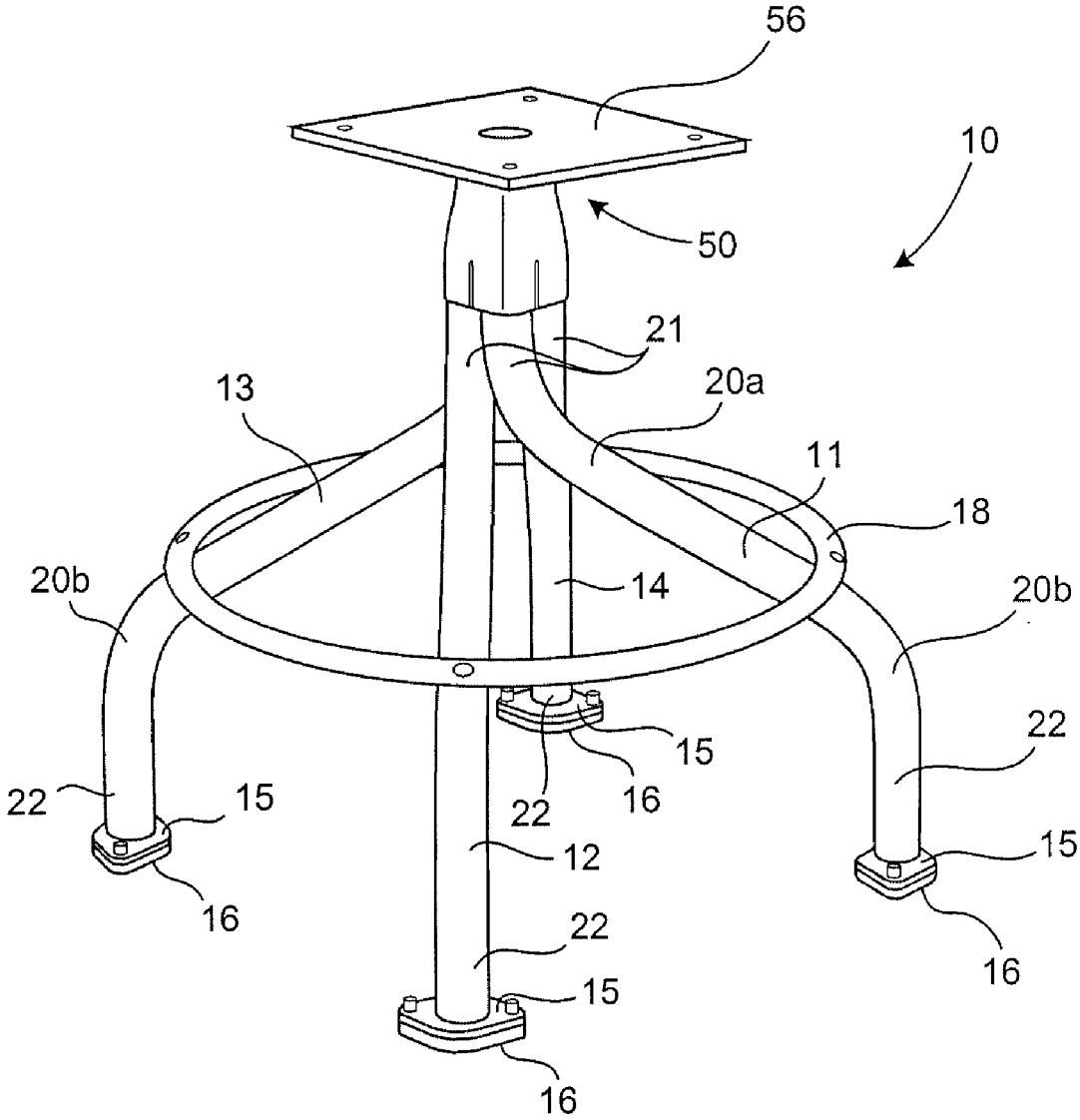
FIG. 1 illustrates a first embodiment of a furniture base of the present invention.

The present invention may be used as a furniture base to support a piece of furniture, such as a chair, table, barstool, or the like. The piece of furniture may be attached to the furniture base such that the furniture base provides support, strength and stability.

As illustrated in FIGS. 1-6, a first embodiment of a furniture base 10 may include at least one leg 11 and a central collector 50. While the Figures illustrate the base 10 as having four legs 11, 12, 13, 14, any number of legs is envisioned and may be implemented, such as a three-legged base, a five-legged base, or the like, though for ease of explanation, a base including four legs will be used in all examples. Each leg 11, 12, 13, 14 may include a top portion 21, a bottom portion 22 and a length therebetween. Each leg 11, 12, 13, 14 may include at least a first curve 20*a*, and may further include at least a second curve 20*b*, along at least a portion of the length of each leg. In this embodiment, each leg lies generally along a single plane, such that if the leg includes two curves, as in FIG. 1, the leg will have a two-dimensional "S" shape.

Each leg 11, 12, 13, 14 may further include a flange plate 15 secured to one end of the leg. In FIG. 1, the flange plate 15 is secured to the bottom portion 22 of each leg, to form a foot for the leg which is positioned on a floor or other surface. Flange plate 15 may further include a glide 16 secured thereto, and be positioned in between the flange plate 15 and the floor. The glide 16 may be made from a polymer, or similar material, and may protect the floor from the, typically, metal flange plate 15. The glide 16 may, for example, have a texture on a bottom surface to increase friction with the floor and provide a better grip, thus increasing stability of furniture base, which may be useful for harder surfaces such as tile, wood, or the like. Alternatively, if for example, the furniture base were being used on a carpet, the bottom surface of the glide 16 may be smooth to minimize friction with the carpet and allow the furniture base to slide.

Figure 5:
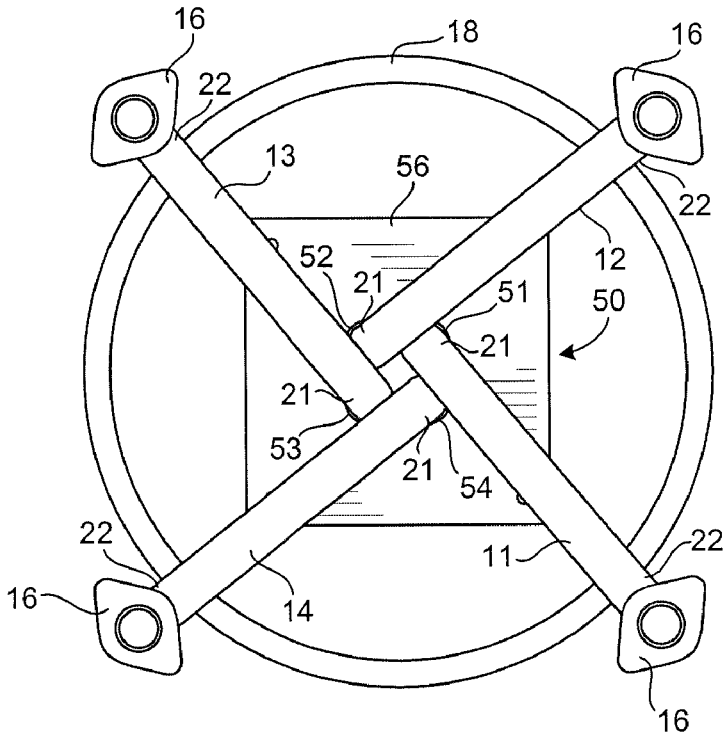
FIG. 5 illustrates a bottom plan view of the base of FIG. 4.

The furniture base 10 may further include a central collector 50. As illustrated in FIG. 5, the central collector houses one of the top portion or bottom portion, in this embodiment the top portion 21, of each leg within one of a plurality of compartments 51, 52, 53, 54 of the collector 50. The plurality of compartments and the plurality of legs are arranged relative to one another such that one of the top or bottom portions of each leg is positioned within each compartment, and the other of the top or bottom portions of each leg is positioned away from the central collector, as in FIG. 1, for example. Thus, each of the portions of the legs positioned within each compartment are positioned in one of the compartments other than the compartment arranged closest to the respective other portion of each leg. In this embodiment, the arrangement of each leg to each compartment is such that each compartment is positioned a certain distance from the bottom portion 22 of each leg 11, 12, 13, 14. For example, in FIG. 5, the bottom portion 22 of leg 11 is positioned to the far lower righthand corner. The closest compartment is compartment 54, which is positioned in the lower righthand corner of collector 50. However, the top portion 21 of leg 11 is instead housed within compartment 51, which is in the upper righthand corner of collector 50 and as such compartment 51 is further from bottom portion 22 than is compartment 54. So, in this example, even though compartment 54 is closest to the bottom portion 22 of leg 11, the top portion 21 of leg 11 is housed in compartment 51 which is a greater distance from the bottom portion 22 than compartment 54.

This positioning of the legs 11, 12, 13, 14 in distant compartments 51, 52, 53, 54, respectively, creates a "spiral" structure and appearance of the legs extending from the central collector 50. This spiral appearance is similarly disclosed in co-pending Design Pat. application No. 29/364,586, filed Jun. 25, 2010, entitled "FURNITURE BASE", listing Louis F. Gasser as inventor, the disclosure of which is incorporated by reference herein as if fully set forth herein. In a first example of the manufacture of base 10, each leg is inserted into a collector 50. Then, the legs are all rotated, relative to the collector, in one direction. For illustrative purposes, in FIGS. 1-4 and 5-6, each leg is rotated in a clockwise direction relative to the bottom view of the base. The legs may then be welded in place, or other similar process to secure the position of the legs relative to the collector. The spiral structure is accomplished, in this embodiment, using planar legs, which provides a stronger and more stable furniture base than if the legs were instead bent in a three dimensional direction to form a spiral, or helical, structure.

In yet another example, referring to FIG. 5, legs 11 and 13 are parallel to one another and are positioned off-center from the central collector 50, being positioned in compartments 51 and 53, respectively. Further, legs 12 and 14 are angled transversely relative to legs 11 and 13, and are themselves off-center to collector 50 and parallel to one another. Legs 11, 13 may be at any angle relative to legs 12, 14, such as perpendicular, as in the illustrated Figures, or at another angle such as 30 degrees, or the like. Of course, when determining the angles, the specified angle would be relative to the adjacent leg selected—for example, leg 12 may be at a 30 degree angle to leg 11, but leg 14 would be at a 30 degree angle to leg 13.

Figure 7:
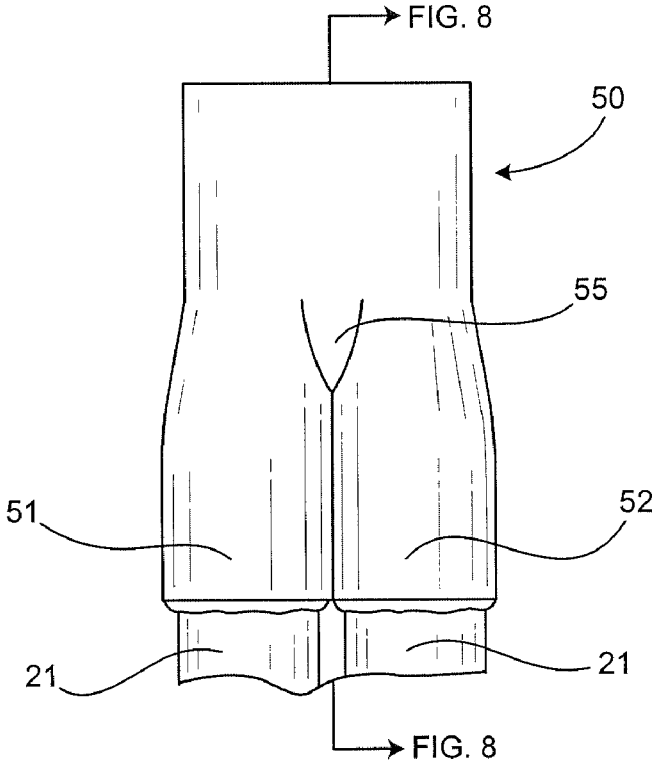
FIG. 7 illustrates one embodiment of a central collector.
Figure 8:
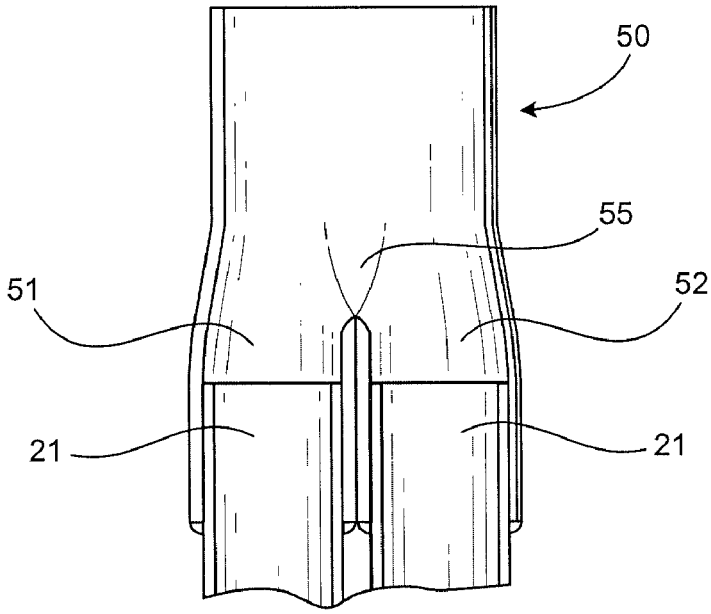
FIG. 8 illustrates a cross-sectional view of the central collector of FIG. 7.
Figure 9:
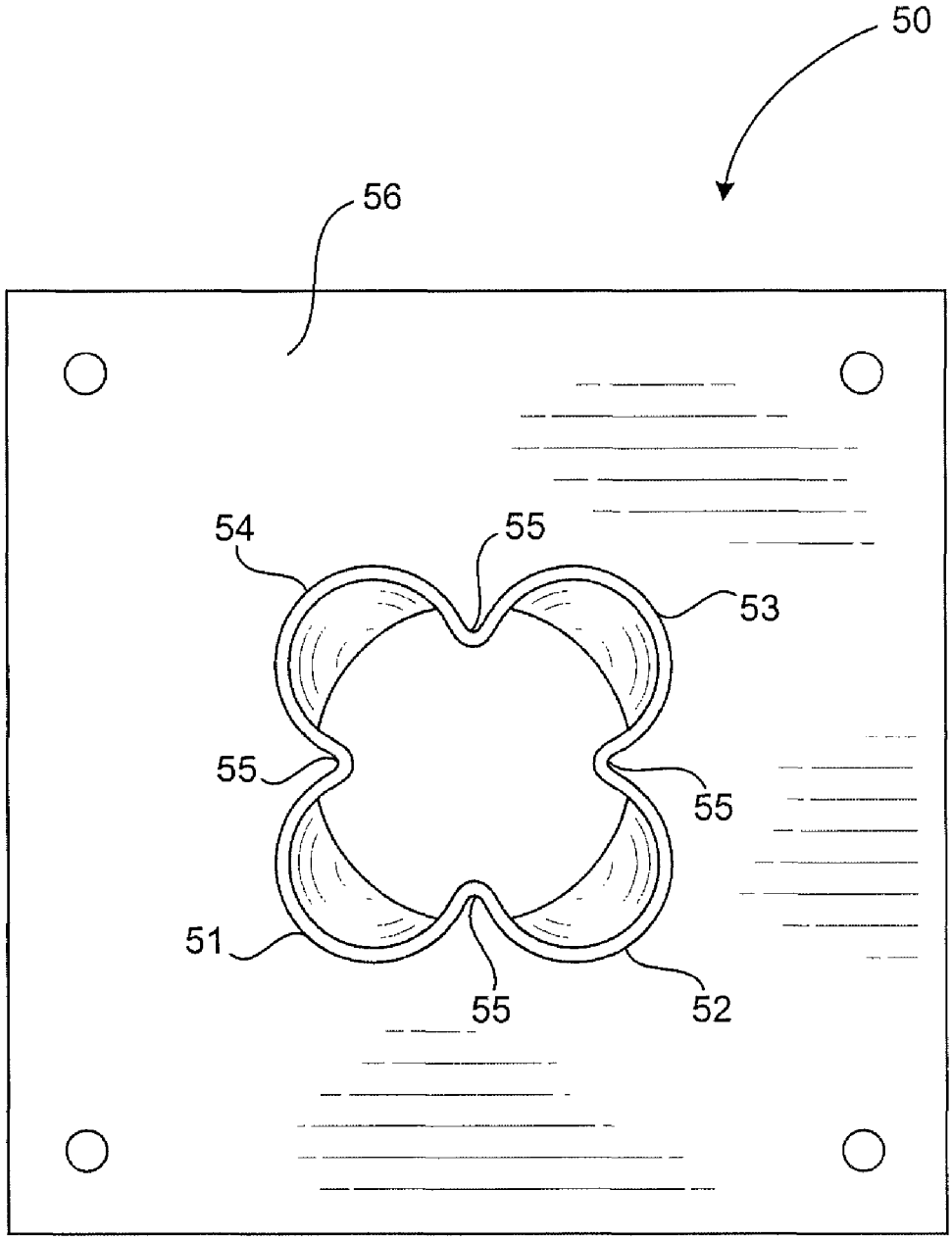
FIG. 9 illustrates a bottom plan view of one embodiment of a central collector with the legs removed from an inner volume of the central collector.

The central collector 50 may be a unitary, generally cylindrical structure, wherein the individual compartments are separated from one another by a deformation 55 of the generally cylindrical structure. As illustrated in FIGS. 7-9, the deformation may be a depressed dimple between two individual compartments. Thus, while the collector 50 is a generally single-piece structure, the depressions segregate the interior volume of the collector into quadrants in which the four legs may be positioned. Of course, it is envisioned that other structures or deformations other than the illustrated dimples may be used.

Figure 2:
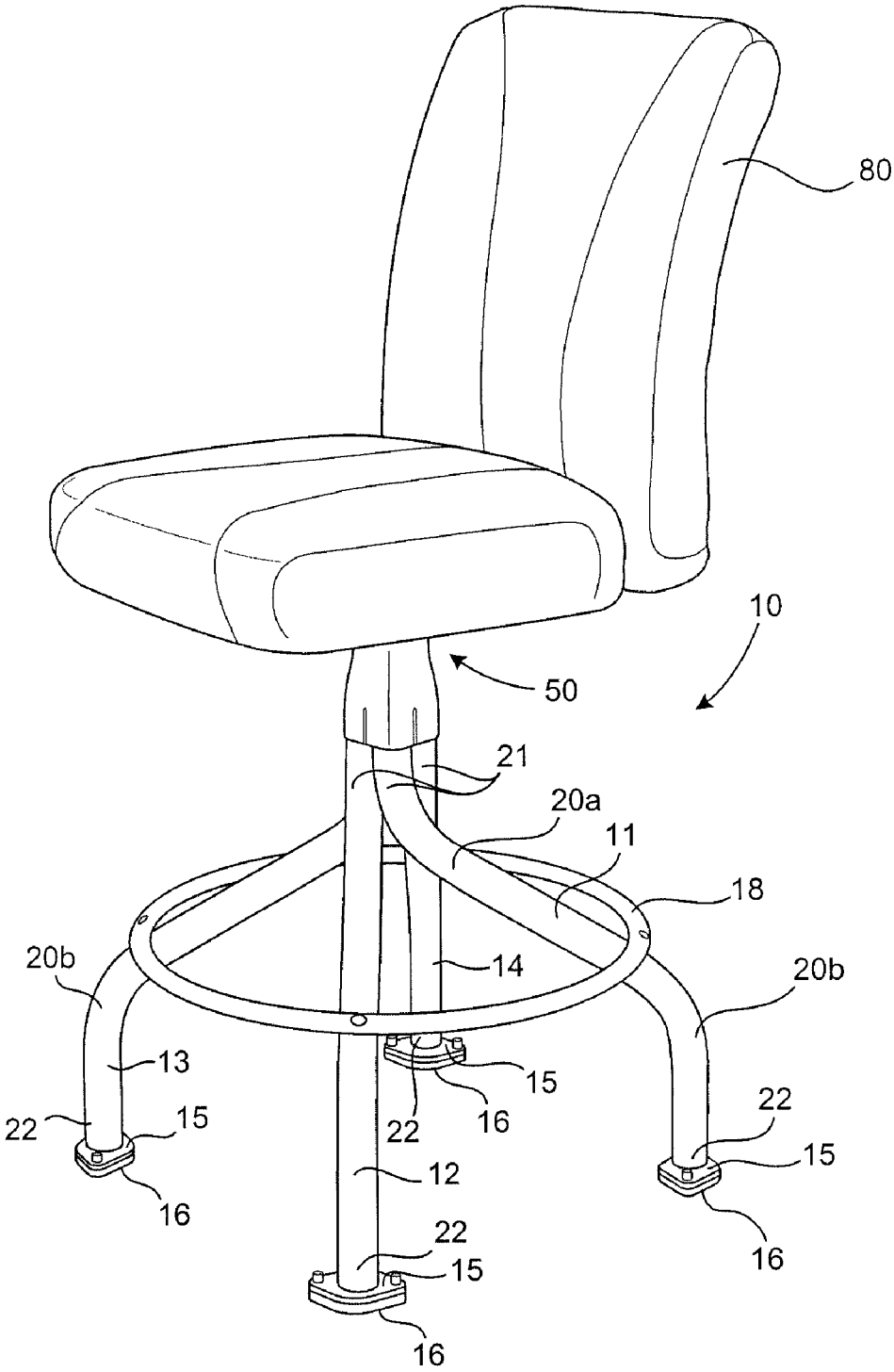
FIG. 2 illustrates the base of FIG. 1, supporting a piece of furniture, a barstool.
Figure 3:
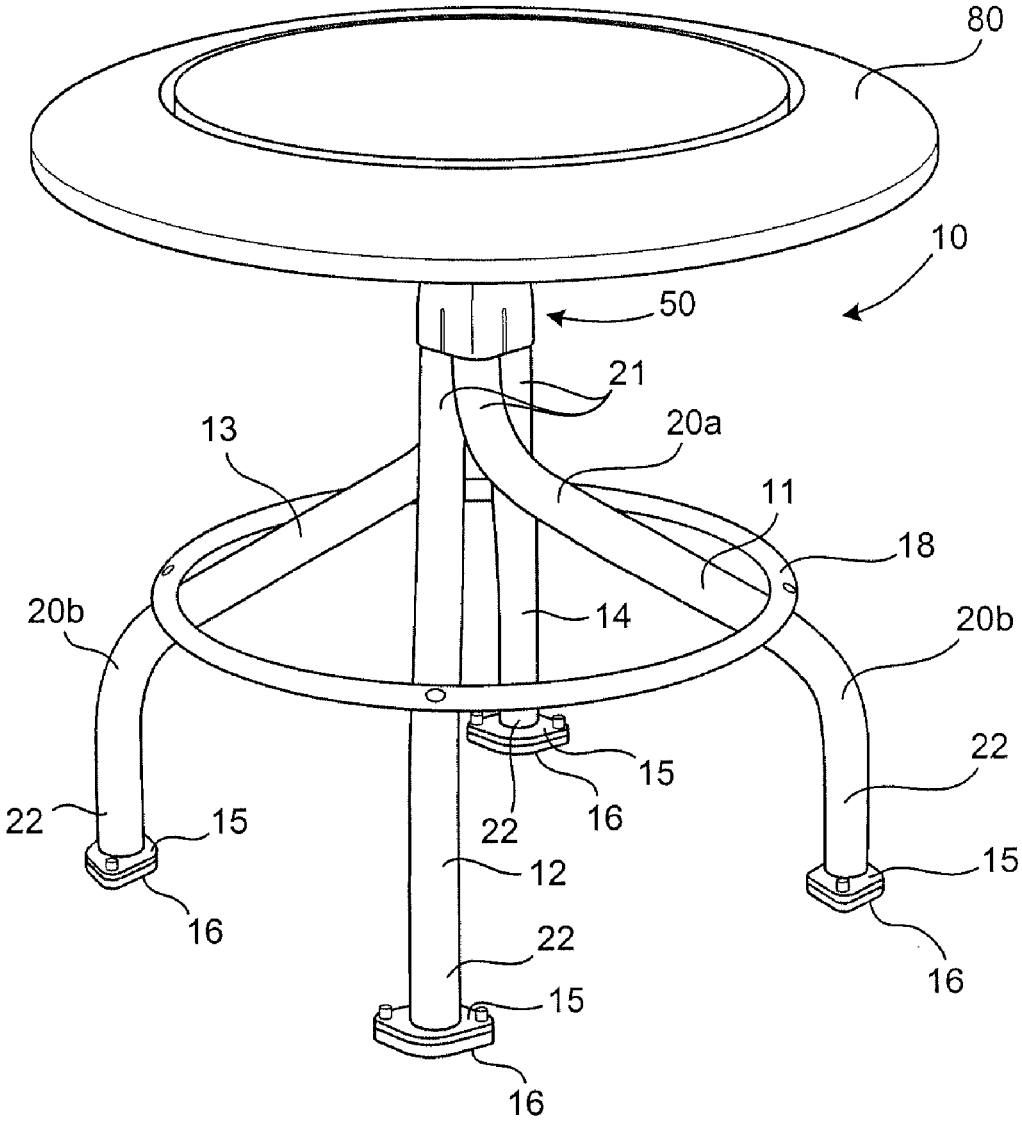
FIG. 3 illustrates the base of FIG. 1, supporting a piece of furniture, a table.
Figure 4:
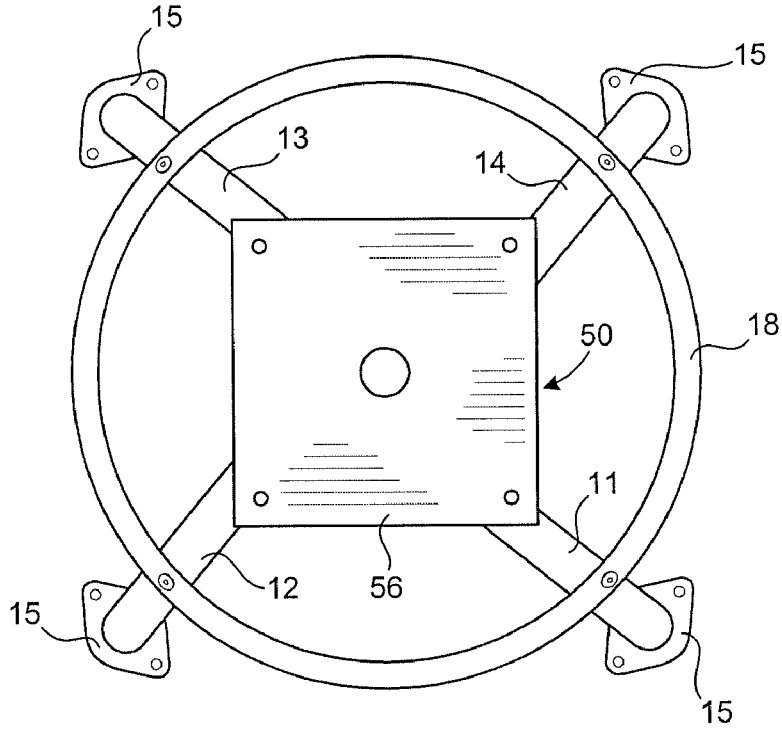
FIG. 4 illustrates a top plan view of another embodiment of a furniture base.
Figure 6:
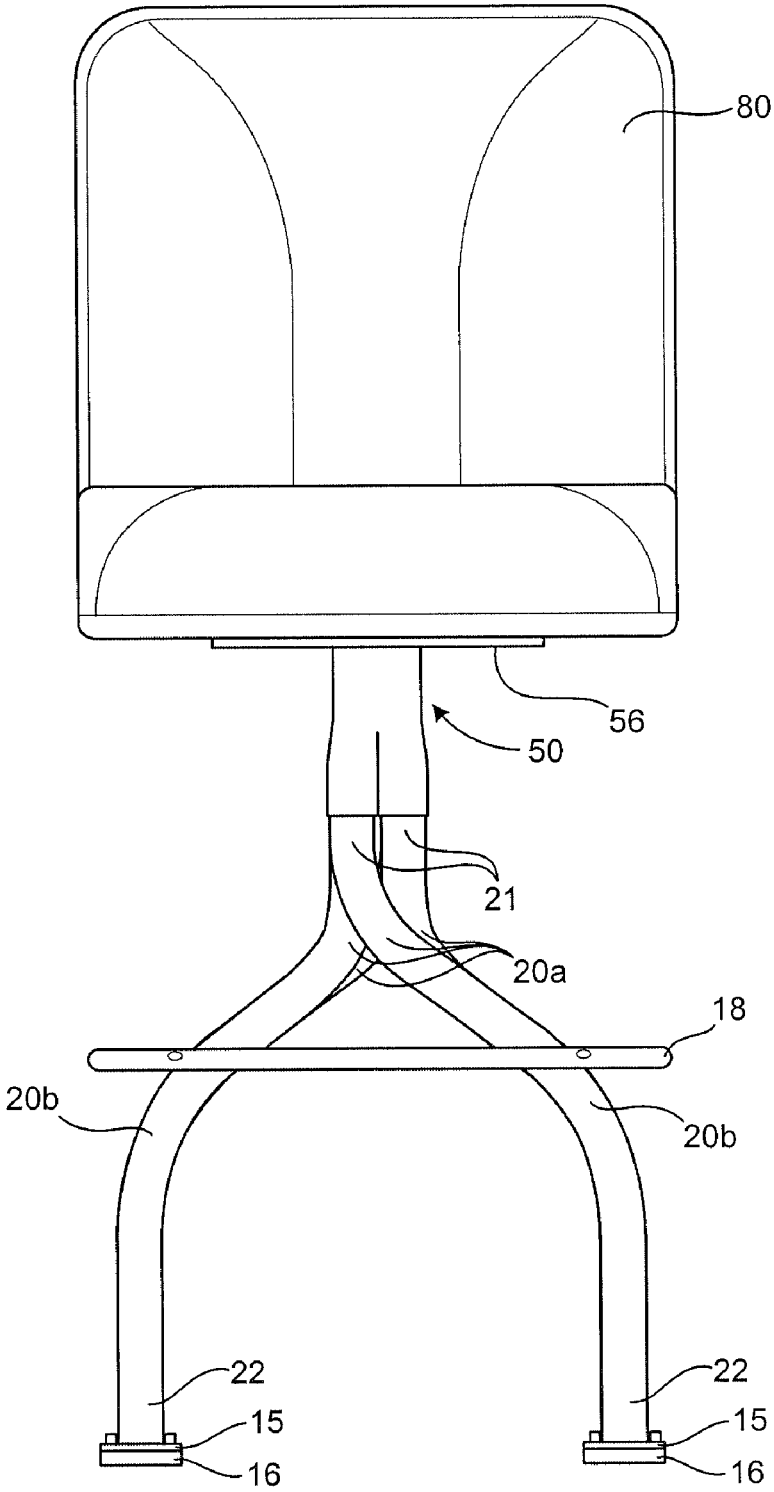
FIG. 6 illustrates a front plan view of the base of FIG. 1, supporting a piece of furniture, a barstool.

The central collector 50 may further include a collector base 56 on which a piece of furniture 80 may be secured by known means, for example, bolts, screws, adhesive, or the like. The base is rigidly secured to the collector by a weld or the like. Alternatively, the collector and collector base may be machined as a single, unitary piece. Exemplary pieces of furniture 80 which may be used with base 10 are illustrated in FIGS. 2, 3 and 6. Such furniture 80 may include chairs, tables, barstools, variations thereof, or the like. If the furniture 80 is a cocktail table or barstool, for example, base 10 may also optionally include a foot rest 18, positioned at a point along the length of the legs 11, 12, 13, 14.

Figure 10:
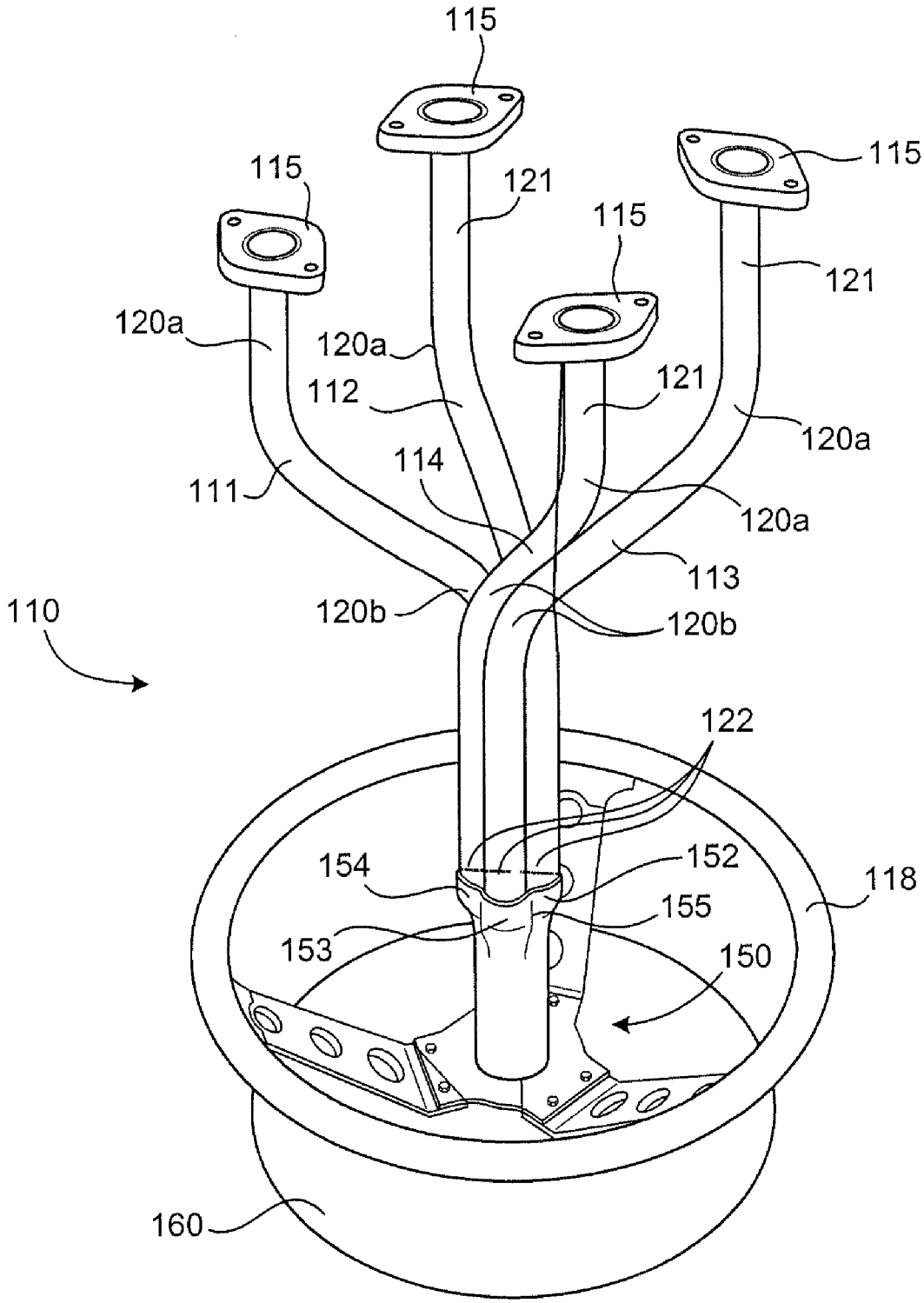
FIG. 10 illustrates a further embodiment of a furniture base of the present invention.

FIG. 10 illustrates a second embodiment of the furniture base 110. Base 110 may include legs 111, 112, 113, 114 and central connector 150. Each leg may have a top portion 121, a bottom portion 122, and at least a first curve 120*a*, and may further include at least a second curve 120*b*, along at least a portion of the length of each leg. In this embodiment, each leg lies generally along a single plane, such that if the leg includes two curves, as in FIG. 1, the leg will have a two-dimensional "S" shape.

This second embodiment is similar to the first embodiment, discussed above, with the main difference that the base 110 is essentially inverted when compared with base 10. Base 110 may include flange plates 115, but they are instead connected to the top portion 121 of each leg. In this embodiment, the flange plates 115 serve as a securing point for a piece of furniture (not shown), such as, for example, a table as is illustrated in FIG. 3. The piece of furniture may be secured to flange plates 115 by any known means, such as bolts, screws, adhesive, or the like. Again, if the furniture is a cocktail table or barstool, for example, base 110 may also optionally include a foot rest 118, positioned on base 110.

The central collector 150, in this embodiment located towards the bottom of base 110, may be a unitary structure and include central compartments 151, 152, 153 (the fourth compartment, 154, is not shown) separated by deformations 155, such as dimples, as discussed above. Thus, while the collector 150 is a generally single-piece structure, the depressions segregate the interior volume of the collector into quadrants in which the four legs may be positioned. Of course, it is envisioned that other structures or deformations other than the illustrated dimples may be used. The bottom portion 122 of each leg 111, 112, 113, 114 is positioned in the compartments as explained above to create the "spiral" structure and appearance.

The central collector 150 may further include a floor base 160 which is secured to the collector and provides a strong and stable support for base 110. The floor base 160 may be secured to the collector 150 by known means, such as bolts or screws, or the like, or may be formed with the collector as a unitary structure, as in the above embodiments.

The legs, flange plates and collector of the present invention may be constructed out of metal, such as aluminum, steel or stainless steel, polymer, or other material which provides sufficient stability and strength to support the intended piece of furniture. In the disclosed embodiments, these structures were constructed from stainless steel. The pieces of furniture attached to base 10, 110 may be any known in the art capable of attaching to collector base 56 or flange plates 115.

It is envisioned that variations of base 10, 110 may also be within the scope of this invention. For example, while the illustrated legs 11, 111, 12, 112, 13, 113, 14, 114 are generally symmetrical, it is noted that each leg can have a different look than the other, whether the difference is in material of construction, dimensions of the leg, or the shape of the one or more curves. Further, an alternative embodiment may include a central collector 50, 150 which may have compartments 51, 52, 53, 54, 151, 152, 153, 154 which are completely segregated from one another, meaning that the volumes of each compartment are completely isolated from the other compartments, as opposed to the deformed arrangement of FIG. 9. This embodiment may be accomplished by the addition of additional material within the volume of the collector to form discrete leg holes for each leg.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A furniture base comprising:

a plurality of legs, each leg including a top portion, a bottom portion, and at least one curve along at least a portion of its length;

a central collector including a plurality of compartments; and the plurality of compartments and the plurality of legs are arranged relative to one another such that one of the top or bottom portions of each leg is positioned within one of the compartments, and the other of the top or bottom portions of each leg is positioned away from the central collector;

wherein, for each leg, the portion of the leg positioned within the compartment is positioned in a compartment adjacent to the compartment positioned closest to the other portion of the leg.

2. The furniture base of claim 1, wherein each leg includes two or more curves along two or more portions of its length.

3. The furniture base of claim 1, wherein each leg lies along a single plane along substantially its entire length.

4. The furniture base of claim 1, wherein the collector houses the top portions of each of the legs.

5. The furniture base of claim 4, wherein the central collector further comprises a base for supporting a piece of furniture.

6. The furniture base of claim 5, wherein the piece of furniture is selected from the group consisting of a chair, a table, cocktail table, and a bar stool.

7. The furniture base of claim 1, wherein the other portion of each leg includes a flange plate.

8. The furniture base of claim 7, wherein the flange plate attaches to a glide.

9. The furniture base of claim 8, wherein the glide comprises a polymer and is adapted to be positioned on a floor.

10. The furniture base of claim 1, wherein the collector houses the bottom portions of each of the legs.

11. The furniture base of claim 10, wherein the top portions of each of the legs include a flange plate for supporting a piece of furniture.

12. The furniture base of claim 11, wherein the piece of furniture is selected from the group consisting of a chair, barstool, cocktail table, and a table.

13. The furniture base of claim 1, wherein each leg comprises a hollow cylindrical tube.

14. The furniture base of claim 1, wherein the central collector comprises a unitary, generally cylindrical structure, wherein the plurality of compartments are separated from one another by a deformation of the generally cylindrical structure.

15. The furniture base of claim 14, wherein the deformation comprises depressed dimples between two individual compartments.

16. A furniture base comprising a first leg, a second leg, a third leg and a fourth leg, each leg having a top portion, a bottom portion, and at least one curve along at least a portion of its length;

a central collector having four compartments, each compartment positioned off-center relative the central collector;

the first leg positioned parallel to the third leg;

the second leg positioned parallel to the fourth leg;

one of the top or bottom portions of each leg positioned in one of the four compartments;

the first and third legs are positioned at an angle transverse to the second and fourth legs.

17. The furniture base of claim 16 wherein the first and third legs are positioned at an angle perpendicular to the second and fourth legs.

18. A furniture base comprising:

four legs, each leg including a top portion, a bottom portion, a first curve and a second curve along at least a portion of its length, the leg lying along a single plane along substantially its entire length;

a central collector including a unitary structure and four compartments, the compartments are separated from one another by a deformation of the unitary structure; and the top portion of each leg positioned in one of the compartments and the bottom portion of each leg positioned away from the central collector such that, for each leg, the bottom portion of the leg is positioned relatively closer to a compartment which is adjacent to the compartment in which the top portion of the leg is positioned.

* * * * *